United States Patent [19]

Harman et al.

[11] Patent Number: 4,987,394

[45] Date of Patent: Jan. 22, 1991

[54] LEAKY CABLES

[75] Inventors: R. Keith Harman, Kanata, Canada; Kenneth L. Smith, East Machins, Me.

[73] Assignee: Senstar Corporation, Ontario, Canada

[21] Appl. No.: 130,192

[22] Filed: Dec. 1, 1987

[51] Int. Cl.[5] ..... H01Q 13/20; H01P 3/02

[52] U.S. Cl. ..... 333/237; 333/243; 174/36

[58] Field of Search ..... 333/237, 243, 1; 343/770, 767; 174/36; 342/27; 340/552

[56] References Cited

U.S. PATENT DOCUMENTS

| | | | |
|---|---|---|---|
| 3,668,573 | 6/1972 | Martin | 333/237 |
| 3,795,915 | 3/1974 | Yoshida | 333/237 X |
| 3,963,999 | 6/1976 | Nakajima et al. | 333/237 |
| 3,975,700 | 8/1976 | Halstead | 333/237 |
| 4,157,518 | 6/1979 | McCarthy | 333/237 |
| 4,323,721 | 4/1982 | Kincaid et al. | 174/36 |
| 4,339,733 | 7/1982 | Smith | 333/237 |
| 4,376,920 | 3/1983 | Smith | 174/36 X |
| 4,599,483 | 7/1986 | Kuhn et al. | 174/36 |
| 4,641,110 | 2/1987 | Smith | 333/243 X |
| 4,687,882 | 8/1987 | Stone et al. | 333/243 |

FOREIGN PATENT DOCUMENTS

| | | | |
|---|---|---|---|
| 21103 | 2/1982 | Japan | 333/237 |
| 234506 | 8/1983 | Japan | 333/243 |

*Primary Examiner*—Eugene R. LaRoche
*Assistant Examiner*—Benny T. Lee
*Attorney, Agent, or Firm*—Antonelli, Terry, Stout & Kraus

[57] ABSTRACT

A leaky cable useful antenna or as an intruder detector sensor either buried in a single trench or above ground substantially reducing sensitivity variations due to the environment. Egression of the electric field from the cable is blocked but magnetic fields escape. The velocity of the externally propagating electromagnetic field is slowed and attenuated. In one embodiment, the leaky coaxial cable is comprised of an inner conductor, a dielectric surrounding the inner conductor, a first external shield having low series impedance at VHF frequencies surrounding the dielectric, means for coupling a magnetic field through the first external shield, a second external shield surrounding the first external shield having high series impedance relative to series impedance of the first external shield and means for limiting VHF conduction current between the shields, which effectively causes separation of the internal and external propagation fields of the cables. The external shields are arranged so that the first external low series impedance shield does not short circuit the second external high series impedance shield, thus separating the internal and external propagating fields of the cable. A thin semiconductor or insulating sheath can be placed between the two shields. Alternatively, the skin depths at VHF in the two shields are made adequate to effectively separate the two signals. The external signal, propagating on the outside of the second external shield and the internal signal propagating on the first external shield are effectively separated thereby.

51 Claims, 3 Drawing Sheets

LEAKY CABLES

FIELD OF THE INVENTION

This invention relates to leaky or radiating cables such as are used as antennas for communication in mines, or in intruder detector sensors, and in particular to a novel form of such cables.

BACKGROUND OF THE INVENTION

A sensor for an intruder detection system is typically formed of a leaky (radiating) coaxial cable, to one end of which is connected a transmitter, typically operating at 40 MHz CW. The radiated field of the transmitted signal penetrates a parallel leaky receiving cable spaced typically 3–8 feet away, and is received by a receiver connected to one end of the receiving cable. When an intruder passes into the radiating field penetrating the received cable, it causes an amplitude and phase change in the field, which is detected in the receiver, thus determining that an intruding body is present. The cables can be either buried or located at or above ground level. Intruder detection systems of this type have been described in a paper by Dr. R. Keith Harman and John E. Siedlarz, given to the 1982 Carnahan Conference on Security Technology, at the University of Kentucky, May 12–14, 1982. While early papers suggest operation on or above ground, this has not proven to be feasible due to huge environmental effects for cables on the surface and mode cancellations for air mounted cables In the case of buried cables, changes in the dielectric constant of the burial medium, e.g. local wet, sandy, oily, etc. regions, significantly affect the sensitivity of the system, so that long sensors often have extreme high sensitivity regions adjacent certain portions of the sensor and poor sensitivity (null) regions adjacent other portions. This can cause generation of false alarms and points of undetectable intrusion. In addition, it is costly to dig two spaced trenches for burial of the cable; in case of a requirement for service, two trenches must be dug up.

Cables located at or above the ground level are visible, thus allowing potential intruders to note and possibly avoid their positions, but also exhibit regularly spaced peaks and valleys in sensitivity. Consequently above ground cable sensors are usually avoided wherever possible.

The present invention is directed to a leaky cable which can be used in a sensor or as an antenna, and to a sensor which is substantially insensitive to variations in dielectric constant and conductivity in the burial medium of a sensor. The sensor containing both transmitting and receiving elements can be manufactured as a single cable, and thus only a single trench need be dug for its burial. The same cable can be used at or above ground level with substantial reduction or elimination of the peaks and nulls exhibited by prior art aboveground sensors. Accordingly a sensor or radiating cable can be used above ground for the first time with predictability and confidence that peaks and nulls will not significantly affect sensor performance.

DESCRIPTION OF THE PRIOR ART

U.S. Pat. No. 4,339,733 issued July 13, 1982, inventor Kenneth L. Smith, is directed to a leaky or radiated coaxial cable having a center conductor, a dielectric surrounding the center conductor and a first conducting foil shield surrounding the dielectric which contains an elongated slot extending along the cable. A second outer foil shield separated from the first foil shield by an insulator surrounds part of the diameter of the first foil shield, leaving a second elongated slot extending the length of the cable. In one embodiment the slot in the external shield is located so it does not overlap the slot in the inner first shield. The radiating shields are said to be formed of copper or aluminum or metal laminates having apertures or other means to permit radiation. The patent states that the presence of the plurality of radiating sheaths in the radiating cable of the invention remarkably decreases the attenuation of the internal TEM signal while providing radiation levels equivalent to conventional radiating coaxial cables. It also states that the internal TEM signal environmental sensitivity is minimized so that the cable functions uniformly in different installation environments. However it has been found that these cable's external signal would exhibit peaks and nulls when located above ground, and if buried, the external signal is affected by variations in burial medium. Further, two burial trenches are required to accommodate both cables where used in a buried sensor in an intrusion detector.

U.S. Pat. No. 3,668,573 issued June 6, 1972, inventor Helmut Martin, describes a pair of parallel spaced conductors contained within the same dielectric which is surrounded, except for a slot, by a shield. The shield is said to stop egress of the electric and electromagnetic components of the field where it is located. The slot is covered by a copper foil which is said to stop the electric field. The electromagnetic field passes through the slot. This cable allows the electric field from one conductor to pass directly to the other within the shield, and the electromagnetic field of one conductor to encircle the other at the shortest possible distance. Accordingly the resulting electromagnetic field set up is of small radius, restricting detection distance. Further, the cable would exhibit peaks and nulls in response if located above ground.

U.K. Pat. No. 1,466,171 published Mar. 2, 1977, inventor Rolf Johannessen, describes a single coaxial cable having a center conductor surrounded by a dielectric medium, which dielectric medium is surrounded by a slotted conductive shield. The outer surface of the shield is sprayed with an electrically conductive material having a conductivity less than that of the shield. The entire cable is then encased in a protective low loss sheath. In a second embodiment there is no sprayed coating over the shield, but the protective sheath is a plastic containing a conductive filler material such as carbon filled polythene or polyvinyl chloride. According to the theory described in the patent, two or more electric currents travelling either in different directions or with different propagation velocities give rise to standing wave (peak and valley) patterns in the field. The patent theorizes that a primary cable transmission mode exists which travels with the normal cable propagation velocity, and in a secondary transmission mode caused by the interaction of the electric currents in the outer surface of the outer conductor with the ground plane outside the cable. The structure of the invention is said to attenuate the current flowing in the outer surface, hence attenuating the secondary mode of transmission, which should lead to a reduction in the standing wave pattern. This structure, if used in a sensor, clearly requires the use of two cables and thus burial in two trenches.

In each case that sensors are formed of spaced buried coaxial cables, using the above inventions, unbalanced and balanced bifilar propagation between the shields of the two radiating cables occurs. These propagation modes have been found to be dependent on the characteristics of the surrounding environment, and gives rise to peaks and valleys in response.

In U.S. Pat. 4,383,225, issued May 10, 1983, inventor Ferdy Mayer, a coaxial cable is described having an inner conductive and intermediate magnetic absorbing layer and outer conductive layers which increase the series impedance for the path between the two conductive sheaths. In one embodiment, it is stated that there is an outer magnetic absorbing layer which increases the impedance of the external surface of the shield of the coaxial cable. This structure is said to eliminate the passage of parasitic high frequency fields into the cable whereby they would interfere with the transmission of signals within the cable. The cable is unsuitable for use in a leaky cable detection system since the provision of a leakage slot or leakage hole would destroy the objective of the invention, that is, to stop fields from interfering with the internally conductive signal. Further, no means for dealing with bifilar propagation is described, and two trenches would be required if used as a sensor in a leaky cable intruder detection system.

U.S. Pat. No. 4,371,742 issued Feb. 1, 1983, inventor A. Manly, describes multilayer shields for transmission lines, for stopping the radiation of electromagnetic fields from power transmission lines. A dual layer shield is used which is formed of an inner layer of copper and an outer layer which is loaded with ferromagnetic or ferrimagnetic materials; the jacket can also be loaded with ferromagnetic particles. The thickness of the power absorption layer is adjusted so that it is of the same order of magnitude as the skin depth. The EMI shielding is said to absorb 90.4% of the radiated power of a 66 MHz RF current. This cable is unsuitable for use in a sensor or as a leaky cable for the same reason as described with respect to the Mayer patent.

U.S. Pat. No. 4,323,721, issued Apr. 6, 1982, inventor John W. Kincaid et al, describes a pair of coaxial cables in a single unit using so-called siamese construction. Each of the coaxial cables is fully surrounded by a shield; each of the cables is contained within the arms of an S-shaped (in cross-section) insulator which separates both of the cables. The patent states that the off-set nature of the shield and the insulated layers of the shielded member allows 100% shield coverage and excellent electrical isolation between the cable circuits. This structure cannot be used in a leaky cable system since there is no place for the electromagnetic field to pass through the shields.

U.S. Pat. 3,906,492 issued Sept. 16, 1975, inventor Jean-Raymond Narbaits-Jaureguy et al, describes a dual cable sensor each conductor being buried in a dielectric medium, and separated by a very short single metal strip acting as a partial shield and somewhat decoupling the two conductors from each other. The whole assembly is positioned on a metal base connected to the shield which assists upward radiation from the conductors. The electromagnetic field radius is very short. The range of such a structure is very small, and there is very high attenuation. Furthermore, if buried, this structure would be very dependent on the surrounding medium since the electric field which escapes from the cable causes the response to be very dependent on the environment; there is close capacitive coupling to the burial medium. Thus the sensor can only be used reliably for short lengths, due to high attenuation, and in order to minimize variations in the surrounding medium which affects its sensitivity.

SUMMARY OF THE PRESENT INVENTION

In general terms, the cables according to the present invention have signals propagating along the inner coaxial cable and signals propagating along the outside of the cable structure. The two signals are primarily magnetically coupled but they are otherwise separated. The structure of the external conductor is important. It is divided into at least two components a first (inner) external shield and a second external shield. They are designed to accentuate magnetic coupling while minimizing capacitive coupling. They also limit VHF conduction current between the outer surface of the second external conductor and the inside surface of the first external conductor.

The present invention is a leaky cable which can be used as an antenna or as an intruder detector sensor either buried in a single trench or above ground and which substantially eliminates sensitivity variations due to the environment. This is effected by substantially blocking egression of the electric field from the cable but allowing magnetic fields to escape, and by substantially slowing the velocity of and attenuating the externally propagating electromagnetic field.

It has been found that magnetic field coupling is less susceptible to environment conditions than electric field coupling. Electric field coupling is highly dependent upon the relative permittivity of the dielectric material surrounding the cable. When a cable is buried in soil, the permittivity has been found to vary dramatically with soil moisture content and frost. Magnetic field coupling is highly dependent on the magnetic permeability of the dielectric material surrounding the cable. Since magnetic permeability has been found not to be altered by soil moisture or frost, magnetic coupling is not affected by the environment.

The external conductor of the cable forms a transmission line within the surrounding soil. This transmission line has an impedance per unit length comprising two components. The first component is the impedance of the coaxial type transmission line formed by the conductor and the surrounding medium. This impedance is strongly dependent upon the surrounding medium. The second component is the self impedance of the conductor itself. By utilizing a helical conductor, this impedance can be increased significantly. The coaxial and self impedances are in series. By making the self impedance large compared to the coaxial impedance, the resulting transmission line impedance becomes independent of the surrounding medium.

The external transmission line also has an admittance per unit length. This admittance also comprises two components. The first component is the admittance of a coaxial type transmission line between the cable jacket surface and the surrounding medium. This admittance is strongly dependent upon the surrounding medium. The second component is the admittance of the coaxial line formed by the outer conductor and the surface of the cable jacket. By making the jacket thick and of low dielectric constant material, this jacket admittance is made very small relative to the soil admittance. In this case, the two admittances are in series and by creating a very small jacket admittance, the resulting transmission line admittance per unit length becomes independent of the surrounding medium.

The propagation properties of the external transmission line are uniquely defined in terms of the impedance and admittance per unit length. If both of these are independent of the surrounding medium, then the propagation properties are independent. These propagation properties and the cable coupling determine the performance of a leaky cable sensor.

A pair of leaky coaxial shields are used, a first one of which is a highly conductive first external shield allowing internal mode transmission at relatively high propagation velocity (say 79% of free space), and a second one of which is a second external shield insulated from the inner first external shield. The second external shield preferably has high resistance and high inductance and may have a high (or controllable) permeability for achieving high attenuation in the second external shield and substantially slowing the external surface wave propagation velocity. The shields stop or substantially attenuate the electric field from egressing from the cable. Means are also included to cause the electromagnetic field to escape from the cable.

According to a further embodiment the cable jacket preferably has a low dielectric constant (relative permittivity), in order to reduce the shunt capacitance to the ambient burial medium. Other means are used to substantially slow the velocity of the electromagnetic wave propagation external to the cable. The resulting cable has been found to be more immune to the characteristics of the environment than existing cables, and allows the same cable to be used in a widely varying burial medium.

One can increase the impedance of the second external shield without affecting the internal propagation path by adding ferrite material between the first and second external shields.

Means are described for varying the permeability within the cable, thus controlling the inductance, and facilitating control of the velocity of the electromagnetic signal carried in the external shield and jacket. The center cable core and second external shield can, for example, be biased to saturation. By passing a direct current down the coil of the second external shield, which sets up a secondary D.C. magnetic field within the cable and can change the cable permeability, the location of any nulls and peaks in response which might occur can be changed to combine with other peaks and nulls, thus smoothing the response. By passing an A.C. current down the coil, a rapidly changing field is set up, thus averaging any peaks and nulls, in effect nullifying their effect.

A preferred embodiment of the invention is a leaky coaxial cable comprising an inner conductor, a dielectric surrounding the inner conductor, a first external shield having low series impedance at VHF frequencies surrounding the dielectric, means for coupling a magnetic field through the first external shield, a second external shield surrounding the first external shield having high series impedance relative to series impedance of the first external shield and means for limiting VHF conduction current between the shields, which effectively causes separation of the internal and external propagation fields of the cables.

The external shields are arranged so that the first external low series impedance shield does not short circuit the second external high series impedance shield, thus separating the internal and external propagating fields of the cable. One way to achieve this result is to place a thin semiconductive or insulating sheath between the two shields. A second way is to ensure that the skin depths at VHF in the two shields are adequate to effectively separate the two signals. The external signal, propagating on the outside of the second external shield and the internal signal propagating on the first external shield are effectively separated thereby.

In general, an embodiment of the leaky cable is comprised of an inner conductor, a dielectric surrounding the inner conductor, and an apertured external conductive shield surrounding the dielectric, whereby an internal propagation path is provided having a low propagation constant, and further including means for providing an external propagation path having high propagation constant. The external propagation path is comprised- of a high series impedance element which can be primarily resistive, primarily inductive, or both.

In a further embodiment, the external propagation path is comprised of a distributed shunt low capacitance element, preferably formed of a thick jacket comprised of low dielectric constant material.

The single leaky coaxial cable as described above and as will be described in more detail below can be used as an antenna in mines or in other environments which in the past have suffered excessive nulls and peaks where the reception of electromagnetic energy has respectively disappeared or been found to be excessive.

In accordance with the sensor embodiment of the present invention the bifilar transmission mode which had resulted in excessive sensitivity dependence on the burial medium or environment is substantially eliminated. This has been achieved by providing a single cable structure in which the first external shields of a pair of leaky coaxial cables which each have generally similar characteristics as the individual cable described above are short circuited along their lengths, either continuously or at least at several places for each wavelength along the cable. The second external shield surrounds both cables together. Means is provided for limiting VHF current flow between the first and second external shields, e.g. by insulating the second external shield from the first external shield. Since the first external shields are short-circuited the sensor can be made as a single dual cable unit, requiring the provision of only a single burial trench.

Preferably the cable structure is fabricated in siamese construction, that is, with a first external shield having an S-shaped cross-section each of the arms of which forms a gapped shield surrounding one of the dielectrics. In contrast to the Kincaid patent, a single first external shield is used to substantially surround both coaxial cables. In addition the first external shield is left gapped. A second highly inductive and highly resistive external shield is preferably insulated from and completely surrounds the first external shield. The gaps are positioned to avoid direct coupling between a transmission line formed by the two elongated conductors and first external shields. The magnetic field which passes out of a gap couples through the second shield creating a relatively intense electromagnetic field external to the cable.

At least the insides of the inner gapped shields surrounding each of the coaxial cables are highly conductive, and are preferably formed of highly conductive polyester backed foil. Wires may be added in electrical contact with the foil to facilitate connectors and to provide lower resistance, particularly at low frequencies. The wires may be either inside or outside the foil tape. The external shield is formed of lossy conductive and preferably high permeability material forming a coil such as was described with respect to the single cable embodiment. An external jacket retains the entire assembly together in a unitary cable structure. The jacket should have low dielectric constant.

In general, the preferred structure of the dual leaky cable structure form of the invention is comprised of a pair of spaced, parallel, elongated conductors, a dielectric surrounding each of the conductors, first external conductive shield means surrounding at least the major portion of each of the dielectrics, the shield means being short circuited along the cable parallel to the pair of conductors, a second external shield surrounding the insulating means, means for coupling magnetic fields which may surround each of the center conductors through the first external shield means, and means for limiting VHF current flow between the first and second shields, such as insulating means surrounding both the first external shield means together, under the second external shield.

Preferably the second external shield is comprised of series high impedance material, surrounding and insulated from both of the first external conductive shield means, the first (inner) conductive shield means being in conductive contact with each other. The first external shield means preferably contain elongated gaps therein along each of the cables to couple the electromagnetic fields surrounding the center conductors through the first shield means. In accordance with a preferred embodiment the first external shield means are formed as a single shield having S-shaped cross-section having arms which contain and are in contact with the dielectrics surrounding each of the cable conductors. The first external shield means in the S-shaped form can itself form the means for inhibiting passage of the electric field, as will be described in more detail below.

The result is the formation of a leaky cable sensor having a substantially slowed propagation velocity of the external electromagnetic fields, and is substantially immune to variations in the dielectric characteristics of its surroundings, which can be buried in a single trench or can be located at or above ground, and has a substantially smoother response than prior art cables, avoiding the high peaks and nulls of prior art structures.

It should be noted that while terminology is used herein which is most closely associated with a transmitting cable, the description is equally applicable to a receiving cable due to reciprocity.

The preferred form of the invention as described above as well as variations thereof are described in more detail below in conjunction with the following drawings, in which:

FIG. 1 is a schematic diagram depicting prior art cables in a leaky cable intruder detection system, FIG. 2 is a vertical sectional view of the earth through one of the buried cables, which passes through a volume of burial medium which has a higher dielectric constant and conductivity than the remainder of the burial medium, FIG. 3 is a response diagram of the cable shown in FIG. 2, FIG. 4 is a response diagram of a leaky cable antenna or sensor above ground, FIG. 5 is a section of a single cable in accordance with one embodiment of the invention, FIG. 6 is a section of the inner portion of cable of FIG. 5, showing a structure for distorting the electromagnetic field, FIG. 7 is a perspective and cut-back illustration of the preferred embodiment of a single cable in accordance with this invention, FIGS. 8A and 8B illustrate various alternative forms of external shields, FIG. 8C illustrates in edge view another alternative form of external shield, FIG. 9 is a section of intruder detector dual cable sensor in accordance with another embodiment of the invention, using the basic form of cable shown in FIG. 5, and FIG. 10 is a cross-section of a further embodiment of the dual cable sensor.

DETAILED DESCRIPTION OF THE INVENTION

Figure 1:
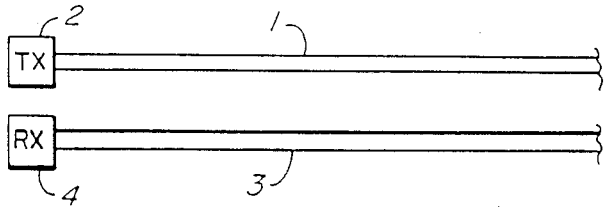

Turning first to FIG. 1, a sensor as used in an intruder detection system is shown in schematic form. The sensor is formed of a leaky coaxial cable 1, to one end of which a transmitter 2 is connected. Disposed parallel to and spaced from leaky coaxial cable 1 is a second leaky coaxial cable 3, to one end of which is connected a receiver 4. The leaky coaxial cables are typically formed using open weave copper braid shield, or slotted or ported unbraided shield, and are usually graded in order to keep the field set up by one and surrounding both cables as constant as possible with distance from the transmitter. The cables are typically separated by e.g. 3–8 feet, and are buried about a foot below the surface of the earth.

A typical intruder detection system of the kind which uses such cables is described in U.S. Pat. No. 4,091,367, issued May 23, 1978, inventor R. Keith Harman. The slots or ports in the cables open progressively from transmitter and receiver to the far ends of the cable to compensate for attenuation in the cables. This compensation is called grading.

Figure 2:
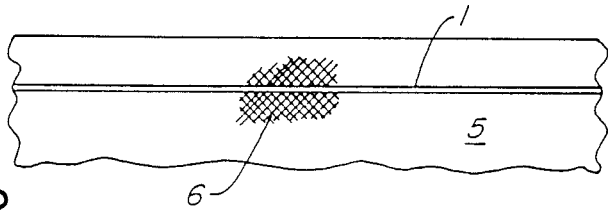

Turning now to FIG. 2 the graded cable 1 is shown buried below the surface of the earth 5. The cable for example passes through a higher dielectric constant and higher conductivity (higher loss) region 6, such as wet soil, the remainder of the burial medium being dry sand.

Figure 3:
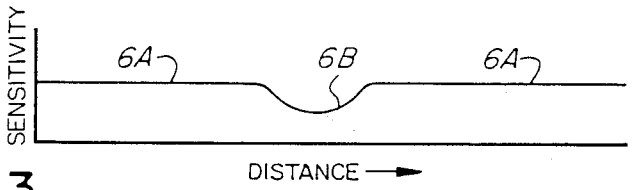

FIG. 3 depicts response (sensitivity) of the example cable of FIG. 2. It may be seen that in a properly graded system the average response 6A is quite uniform, except in the region 6B having a high dielectric constant and higher conductivity where the average response is significantly reduced. Thus in this region 6B the system using the cable would be considerably less sensitive and have significantly less ability to detect an intruder.

In more generally high loss media, there could be regions where there are regions of lower loss where the response becomes inordinately high, which would cause detection of persons or vehicles at an unexpected distance from the cables, thus causing false alarms.

Figure 4:
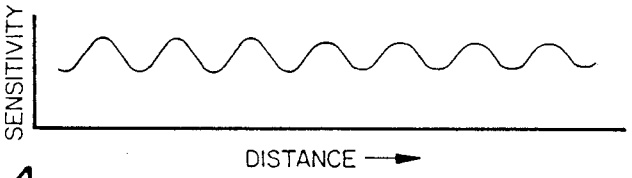

Periodic sensitivity peaks and nulls often occur along the sensor cables as shown in FIG. 4 particularly for above ground cables. The peak to null ratio appars to be higher at the forward end of the system for forward propagation, and gradually decreases toward the distant end as shown in FIG. 4. However the backward wave propagation creates an increasing peak to null ratio toward the distant end (not shown). The cumulative response would be the sum of the two response curves. This phenomenon is increased with decreasing attenuation and increased propagation velocity associated with the external bifilar and monofilar modes.

As was noted earlier cables could not reliably be used above ground in intruder detectors, or indeed, leaky cable antennae could not reliably be used above ground at typical frequencies of 30–100 MHz because extreme peaks and extreme nulls in response are observed. Therefore an intruder having knowledge of the locations of the nulls could pass through the system. Similarly in a communication system, i.e. in a tunnel, no communication could be effected in the null areas, which could break synchronization of transmitter and receivers, cause loss of control of remote radio controlled apparatus, and create hazardous conditions for operation of means which depend on the electromagnetic transmission.

In the present invention the effect of the surrounding environment on the cables is substantially attenuated, sufficiently so that a smooth response substantially without peaks and nulls is observed. Thus where a dual cable sensor in accordance with this invention is used above ground, an intruder would be unable to circumvent it, since nulls and peaks are significantly reduced, and false alarms caused by undue sensitivity can be substantially avoided. In the dual cable sensor, which is buried, substantial independence of the surrounding medium is obtained, resulting in a constant average response in a graded cable, or in a smoothly decreasing average response in an ungraded cable.

Figure 5:
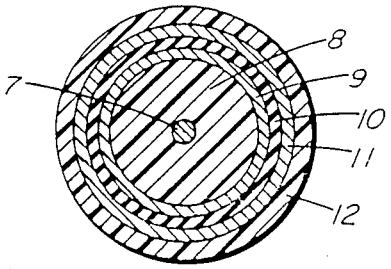

FIG. 5 is a cross section of the single leaky cable embodiment of the invention in its most generalized form. The cable is formed by a center conductor 7 surrounded by a dielectric 8. The dielectric is surrounded by a first external shield 9, which is surrounded by a thin insulating or semiconductor sheath 10. The thin sheath 10 is surrounded by a second external shield 11, which, preferably is surrounded by a protective jacket 12. In fact, the separating sheath 10 may be omitted depending upon the materials selected for the first and second external shields. For example, if the skin depths of the conductors at the VHF frequencies of the signals carried is less than the thickness of the shields, the sheath may be eliminated. These structures perform the function of limiting VHF current flow between the first and second external shields.

A structure is incorporated so that the electromagnetic field due to a VHF radio frequency signal carried by the cable and surrounding the center conductor 7 is coupled through the first external shield. This can be accomplished by providing apertures, which can be in the form of a single elongated slot, in the first external shield.

At least the outside of the center conductor 7 should be highly conductive, as should be at least the inside of the first external shield 9. However the second external shield 11 should have high series impedance, and preferably is both highly resistive and highly inductive but can be either. The jacket 12 is preferred to be formed of low permittivity material and of sufficient thickness to create minimal capacitance to the burial medium, e.g. permittivity of at least as low as 1.6, and jacket outside diameter at least approximately four times the diameter of the second external shield outside diameter.

Since the VHF signal is typically carried at the outside of the conductor, the center conductor 7 can be formed e.g. of copper, or, usefully, by a high permeability material such as stainless steel covered by a copper layer. The dielectric 8 can be foamed polyethylene, which provides a relative propagation velocity within the cable of 79%. The first external shield 9 can be formed of conductive foil such as polyester backed aluminum, which can be applied to the cable as a cigarette foil covering the dielectric 8 and lay parallel to the center conductor 7, with the aluminum facing inwardly. A plurality of wires (not shown in FIG. 5 but shown in other Figures) such as tinned copper clad steel wires can be wound with a low pitch angle around the dielectric, below the first external shield and in electrical contact with the aluminum, to facilitate connection to the shield and to improve the low frequency conduction. However they can be wound alternatively around the outside of the first external shield, or deleted by the use of sufficiently conductive foil, such as copper.

The thin layer 10, if used, can be polyester tape or a semiconducting plastic tape.

The second external shield 11 can be formed in several ways. In one embodiment it can be formed of high resistance, and high permeability material such as mumetal tape or stainless steel, or polyester backed iron wound with a high pitch angle around the cable. A helical outer wire such as steel surrounds the highly resistive tape, so as to form a high inductance element.

The high resistance and high inductance of the external shield provides the necessary high attenuation of the outer propagation mode in order to substantially slow the velocity of the externally propagating electromagnetic wave.

Mumetal has a resistivity of $62\times10^8$ ohm-m and relative permeability at 0.002 weber/$m^2$ of 20,000. An alternative metal to be used as the tape in the second external shield is SUPERMALLOY (a trade name of Arnold Engineering for a metallic alloy with a minimum permeability of greater than 1,000,000) which has resistivity of $60\times10^8$ ohm-m and relative permeability at 0.002 weber/m2 of $10^5$, for example.

Another embodiment of the second external shield is a plurality of high permeability, high resistance wires, such as stainless steel, and wound helically around the cable with a high pitch angle and 100% optical coverage. The material of the wires thus provides the high resistance required, and the large number of turns at a high pitch angle provides high inductance. With the wire having high permeability, the inductance is further increased. Further, if the center conductor 7 has a high permeability core such as stainless steel, the inductance is further increased.

Moreover, by passing a direct current down the wire which forms the second external shield, or by passing a direct current down the wire which forms the outside layer of the second external shield, a secondary D.C. magnetic field is set up within the cable, the permeability of the cable can be increased, and indeed if desired can be magnetically biased to saturation. As a result the velocity of the externally propagating wave can be further slowed, and indeed can be controlled by means of the direct current passing down the inductor of the external shield. An A.C. current can be used instead, to average any peaks and nulls that may exist.

It was noted earlier that the electromagnetic field within the cable is to be coupled out of the cable. The cable structure between, and including the center conductor and the first external shield performs this function. The function of the second external shield is to both stop egress of the electric field, and to substantially slow the velocity and increase the attenuation of the externally propagating electromagnetic wave.

Figure 6:
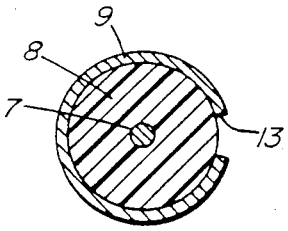

Coupling of the electromagnetic field can be achieved by several means. For example, the first external shield 9 can be slotted, as shown in cross-section in FIG. 6, or it can be otherwise gapped. Indeed, any radiating sheath can be used. FIG. 6 illustrates the center conductor 7 embedded within dielectric 8, and covered by the first external shield 9. The shield in this case contains a slot 13 which extends parallel to the center conductor. In the case in which the first external shield is a cigarette foil, e.g. polyester backed aluminum foil tape, the tape is made narrower than the diameter of the dielectric 8 and once wrapped around the cable, the slot 13 is formed. The structure outside the first external shield 9 is as described earlier, and is not reproduced in FIG. 6. By progressively increasing the size of the slot, the cable can be graded.

The first external shield 9 can also be formed totally surrounding the dielectric 8, but containing holes, slots, etc. along the cable. Shields containing slots which would be suitable for use are shown in Canadian Pat. 1,014,245, FIGS. A, B, D and E.

Figure 7:
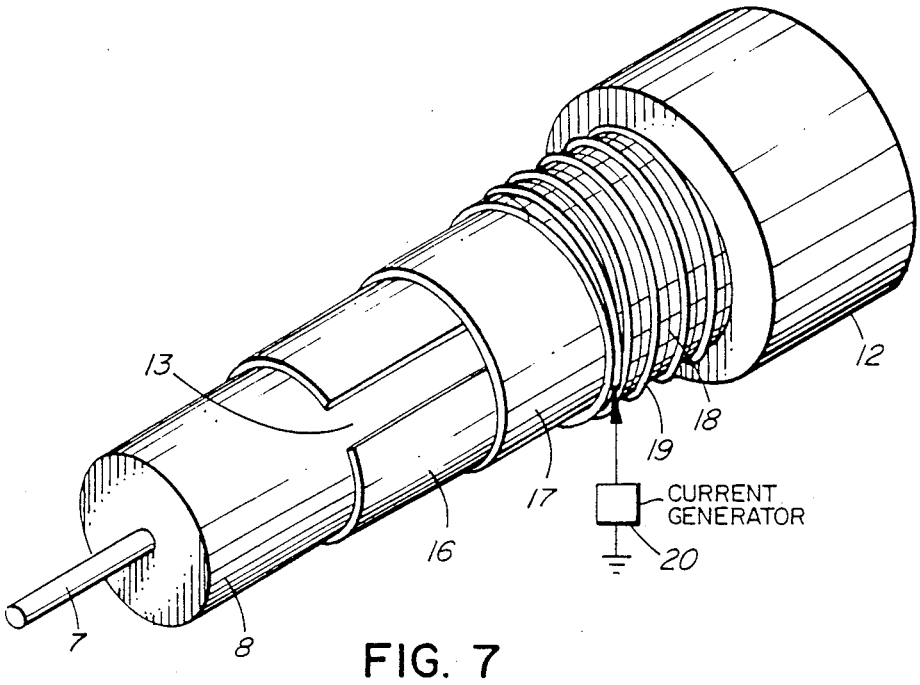

FIG. 7 illustrates in perspective, a partly unwrapped illustration of the preferred embodiment of the single cable form of the invention. Center conductor 7, which can be copper but is preferably copper clad stainless steel is surrounded by a foamed polyethylene dielectric 8. A first external shield is formed by an inner layer comprised of a cigarette foil of polyester backed aluminum foil tape 16. Slot 13 extends along the cable parallel to the center conductor 7.

In order to facilitate connection of a connector to the cable, a group of wires (not shown) can overlay or underlay the first external shield 16, and make continuous conductive contact with it. The connector would make contact with the wires, which make contact with the shield. However if the shield is sufficiently conductive and has sufficient strength, the wires can be deleted.

If used, a thin layer of insulating or semiconducting plastic, e.g. polyester tape 17 surrounds the cable above the tape 16, separating it from the second external shield.

The second external shield is formed of tape 18 made of high resistance and preferably high resistance and high permeability material such as mumetal, SUPERMALLOY or stainless steel. The tape 18 is surrounded by high resistance wires 19 which are wound around the tape 18 windings, in conductive contact with them. Both tape 18 and wires 19 are wound with a high pitch angle (e.g. 70°) in order to provide high inductance. Further, by winding tape 18 with a high pitch angle, the resistance is increased. Covering the second external shield is a thick low permittivity protective jacket 12.

The pitch direction of the conductive wires 19 can be in either the same or opposite direction as that of wires making contact with the first external shield, if the latter wires are used.

The highly conductive first external shield performs the function of coupling the electromagnetic field, allowing the internal propagation mode to be carried with low attenuation and high velocity. On the other hand the highly resistive and highly inductive second external shield with its virtually 100% optical coverage stops egress of the electric field, slows the propagation velocity of the outer electromagnetic field relative to the velocity of the electromagnetic field internal of the cable, and provides appreciable attenuation of the outer electromagnetic field (e.g. 0.1 to 1.0 dB per meter). The capacitance of the cable to the environment is also substantially decreased by the use of thick and low permittivity jacket. This is of importance when the cable is buried.

If one passes direct current (by means of a current generator 20) down the external shield, a secondary magnetic field is set up within the cable by the helical coil formed by wires 19, and the permeability of the cable, e.g. the permeability of the second external shield and of the center conductor can be varied (for example between 2,000 and 500,000) to saturation. Therefore the current can be used to vary the velocity and attenuation of the outer propagating electromagnetic wave by changing the impedance of the external path. As a result should imperfect construction, residuals, or reflections cause some peaks and nulls in response to be observed, they can be smoothed out by cancellation, by varying their location, as a result of varying the current in the external shield. Indeed, the current can be made alternating, to average and thus nullify the effect of the nulls and peaks. If rain or dust changes the velocity of external electromagnetic field, the net velocity can be corrected by means of the direct current. The external field strength radial rate of decay can also be changed.

For this embodiment it is desirable to have an insulator or semiconductor having resistance much higher than that of the second external shield interposed between the shields.

Rather than forming the second external shield as shown in FIG. 7, a plurality of parallel high permeability wires can be wrapped, ungapped, tightly with a high pitch angle around the insulator 17. If very thin stainless steel wires are used, they will exhibit high resistance and their high pitch angle will produce the desirable high inductance.

Figure 8A:
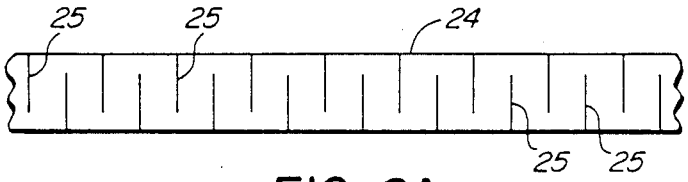
Figure 8B:
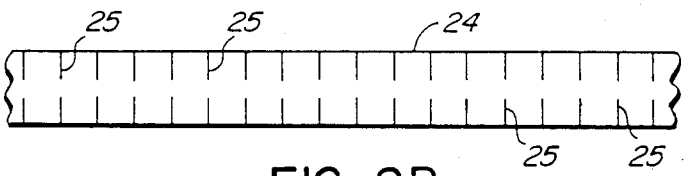
Figure 8C:
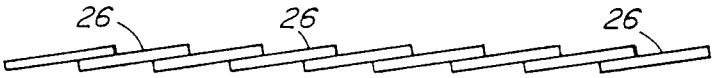

Alternate forms of high resistance second external shields are shown in FIGS. 8A, 8B and 8C. In FIG. 8A the resistance is increased by increasing the current path length. Such a shield, flattened out, is illustrated. The external shield 24, formed of mumetal or the like as described earlier, contains inwardly directed cuts 25, the cuts alternating from each edge of the shield. It will be seen that the current passing along the shield from left to right must take a sinuous, and therefore longer path than otherwise, thus encountering increased resistance.

Another form of the higher resistance shield is shown in FIG. 8B. In this case the shield 24 contains cuts 25 extending toward each other toward opposite edges of the shield, leaving narrow gaps between each pair of cuts. In this case current passing down the length of the shield pass through the narrow gaps between the adjacent ends of the cuts, thus encountering increased resistance.

Another variation in the external shield is shown in FIG. 8C, the shield being shown edgewise. In this structure short 26 pieces of mumetal or other suitable material are disposed one overlapping the next, similar to fish scale.

In each case to increase the inductance, a wire as described earlier can be helicaly wrapped around the cut tape of which the shield is comprised.

Figure 9:
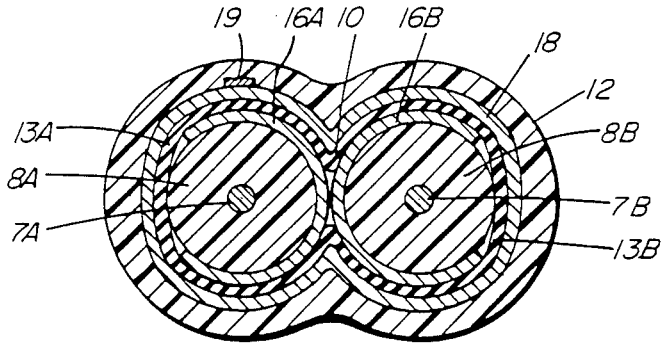

For use as a dual cable sensor, variations in sensitivity as described earlier with respect to FIG. 4 are believed to occur due to a bifilar mode of signal propagation, and is most pronounced when the dual cable sensor is located in air. According to the present invention, rather than spacing the cables as in the prior art, the first external shields of a pair of cables each of which is generally similar to the cables described above have their first external shields short-circuited along the cable. Turning to FIG. 9, a pair of cables comprising center conductors 7A and 7B are surrounded by dielectrics 8A and 8B. Each of the dielectrics is surrounded by a first external shield, preferably comprised of conductive tapes 16A and 16B of similar structure as described earlier. The tapes are positioned so that their gaps 13A and 13B are facing opposite each other. In general, the gaps should be positioned to avoid direct coupling between the individual coaxial cables.

Covering the entire structures so far described is a thin insulator 10A, which completely surrounds the outside of both cables together including the gaps 13A and 13B, in order to limit VHF conduction current between the first and second external shields. However the sufficient skin depth structure as described earlier can be used (if the secondary magnetic field is not to be used), and the insulator 10A deleted.

The second external shield surrounds the insulator 10A, and is comprised of the materials as described earlier. For example it can be formed of high resistance and high permeability tape 18A, over which is wound, at a high pitch angle, wires 19A. The entire structure is surrounded by a low permittivity jacket 12A.

The external shield stops the electric field from passing out of the cable, and thus, with the low permittivity jacket, decreases the capacitance of the cable to the ambient burial medium. The gaps 13A and 13B, by facing in opposite directions, minimize direct coupling, from one center conductor to the other.

The shields can be in continuous contact, or can be short circuited along their lengths several times in each wavelength, e.g. every 6 or 12 inches, where a 40 MHz signal is used.

Figure 10:
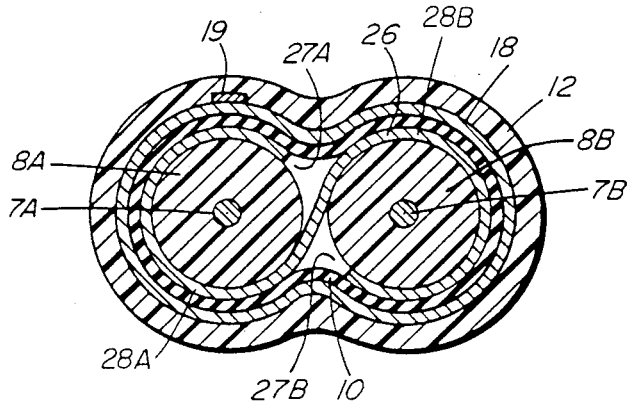

FIG. 10 shows an alternate embodiment. The center conductors 7A and 7B are contained within dielectrics 8A and 8B as described earlier. However in this case a single foil 26, having an S-shaped cross-section, envelopes and contains within each arm the structure of dielectric 8A and center conductor 7A, and dielectric 8B and center conductor 7B respectively. Wires for connection of a connector can be used as described earlier.

Gaps 27A and 27B are located between the ends of the respective arms 28A, 28B of the S-shaped foil and the spine 29, and extend parallel to the axis of the cable. The presence of the gaps cause coupling of the electromagnetic fields through the shield in each of the arms.

Means for limiting VHF conduction current between the first and second shields, e.g. a thin insulator 10A similar to that described earlier with respect to FIG. 10 surrounds the foil 26. Alternatively the sufficient skin depth structure described earlier can be used. A second external shield similar to that described earlier, e.g. formed of tape 18A which is surrounded by helically wound wires 19A, surrounds the thin insulator 10. The tape should of course be highly resistive, preferably high permeability, and wires 19A, wound with a high pitch angle as described earlier around tape 18A, and should provide high inductance. The external shield can be in any of the forms described earlier.

Surrounding the second external shield is a jacket 12A, as described earlier, preferably having low relative permittivity. It is recognized however that the relative permittivity of this jacket also affects the propagation velocity and that too low relative permittivity (approaching unity) can cause peaks and nulls to reappear just as in an air mounted sensor. Hence it is the combination of high second shield impedance and low permittivity jacket which provides the desired effect. In some instances the jacket sensitivity may still be relatively high to achieve the desired effect so long as the impedance of the second shield is high. By the use of the term high impedance with reference to the second shield, it is meant that its series impedance is higher than that of the impedance of itself with the return path.

The structure of FIG. 10 using a single S cross-section form of first external shield, creates coupling of the electromagnetic fields which surround center conductors 7A and 7B, and the electric fields which pass out of the gaps are stopped by the second external shield. The second external shield also provides a substantial slowing of the propagation velocity of the electromagnetic field which passes out of the cable. It is also possible that more than two external shields can be used to provide the desired internal and external propagation paths along with the desired coupling between the antenna and external propagation modes. The thick and low permittivity jacket further decreases the capacitance of the cable to the burial medium.

Since a single S-shaped foil is used in the first external shields of both cables, the effect is the provision of short circuited first external shields, eliminating bifilar propagation, and the peaks and nulls in response caused by bifilar propagation.

It has been found that the same structure described herein used as a sensor can be both successfully buried below ground, and be substantially immune to surrounding burial medium dielectric and loss variations, and can be used above ground with substantially reduced peaks and nulls from that previously experienced. Response of the cable is substantially uniform and unvarying in a graded cable, or smoothly decreasing from one end to the other of a non-graded cable in both cases, (ignoring reflections). Because of the unitary construction only a single trench need be dug, substantially decreasing the cost of installation. Further, since the cable response is so predictable, substantially reduced adjustments are required during installation of the cable, further decreasing the cost of the system. In case of a requirement for service, only a single trench need be dug up. Because the sensor is substantially immune to its environment, variations in response are minimized with changes of weather, e.g. rain, ice and snow, dryness, etc. Thus the same cable can be used above or buried below ground with predictable, reliable response.

By passing a direct current along the cable external shield, variations in velocity of the externally propagating electromagnetic field, caused by e.g. the cable being wet in rain, can be compensated for by varying the permeability, and thus the velocity of the external propagating field. This also varies the radial decay rate of the external field.

The single leaky gradable cable structure is also utilizable as an antenna either below ground or above ground, with substantially reduced peaks and nulls or decreases in sensitivity. By varying the permeability the peaks and nulls which do exist will move. If this is done at a sufficiently high rate they will effectively disappear.

Persons understanding this invention may now conceive of various alternative structures or variations of the present invention using the principles described herein. All are considered to be within the sphere and scope of this invention as defined by the claims appended hereto.

We claim:

1. In a cable structure, at least one leaky coaxial cable comprising an inner conductor, a dielectric surrounding the inner conductor, a first external shield having series impedance with a low resistance at VHF frequencies surrounding the dielectric, a second external shield having series impedance which is high relative to the series impedance of the first external shield surrounding the first external shield, means associated with the shields for coupling magnetic field through the shields, and further means associated with the shields for limiting VHF conductive current between the first and second external shields.

2. A cable as defined in claim 1 in which the second external shield is comprised of high resistance material.

3. A cable as defined in claim 1 in which the second external shield is formed as a high inductance element.

4. A cable as defined in claim 1 in which the second external shield is comprised of high reactance material.

5. A cable as defined in claim 1 in which the first external shield is comprised of an elongated conductive foil longitudinally disposed along the cable, the edges of the foil forming a longitudinal gap extending lengthwise along the cable.

6. A cable as defined in claim 1 in which the first external shield is comprised of a layer of spaced wires helically wound with a low pitch angle around the dielectric and an elongated conductive foil in conductive contact with the wires surrounding the wires longitudinally disposed along the cable, the edges of the foil forming a longitudinal gap extending lengthwise along the cable.

7. A cable as defined in claim 1, in which the first external shield is comprised of an inner layer formed of an elongated conductive foil, longitudinally disposed along the cable, and an outer layer formed of spaced wires helically wound with a low pitch angle around and in conductive contact with the conductive foil, the edges of the foil forming a longitudinal gap extending lengthwise along the cable.

8. A cable as defined in claim 5, in which the second external shield is comprised of foil tape helically wound around the first external shield.

9. A cable as defined in claim 3, in which the second external shield is comprised of a wire conductor helically would with a high pitch angle around the first external shield so as to form said high inductance element.

10. A cable as defined in claim 9, in which the wire conductor is comprised of high reactance wire.

11. A cable as defined in claim 2, 9 or 10 in which the first external shield is comprised of an elongated foil longitudinally disposed along the cable, the edges of the foil forming a longitudinal gap extending lengthwise along the cable.

12. A cable as defined in one of claims 1–10, in which the limiting means is comprised of a thin insulator interposed along the cable structure between the first and second external shields.

13. A cable as defined in claim 3 in which the second external shield is formed of foil having high magnetic permeability surrounded by a helically wound wire conductor in conductive contact therewith so as to form said high inductance element.

14. A cable as defined in claim 13 in which the inner conductor is formed of a high permeability material core covered by a layer of highly conductive material.

15. A cable as defined in claim 14 in which the inner conductor is formed of copper clad steel wire.

16. A cable as defined in claim 13 in which the foil of the second external shield is helically wound around the cable with overlapped turns insulated one from the other, so as to provide virtually 100% electric field shielding 17. A cable as defined in claim 13 in which the foil of the second external shield is segmented with short overlapping segments, the segments being insulated one from the other so as to substantially prevent longitudinal currents therethrough while providing virtually 100% electric field shielding, the segments being in electrical contact with the helically wound wire conductor.

18. A cable as defined in claim 13 in which the foil of the second external shield is partially segmented, and contains cuts through alternating sides forming a meander line.

19. A cable as defined in claim 2 or 13 in which the second external shield is formed of foil containing cuts through alternate sides thereof forming a meander line.

20. A cable as defined in claim 1 or 3 in which the second external shield is formed of high reactance wire wound with a high pitch angle around the first external shield.

21. In a cable structure, at least one leaky coaxial cable, comprising an inner conductor, a dielectric surrounding the inner conductor, and a first external apertured conductive shield surrounding the dielectric, whereby a propagation path internal to the cable between the inner conductor and conductive shield is provided having a low propagation constant, and further including means for providing a propagation path external to the cable outside the conductive shield having a high propagation constant.

22. A cable as defined in claim 21, in which the external propagation path is comprised of a distributed series high impedance element along the cable.

23. A cable as defined in claim 22, in which impedance element is comprised of at least one of a distributed high inductance and high resistance element.

24. A cable as defined in claim 21, 22 or 23 in which the external propagation path is further comprised of a distributed shunt low capacitance element distributed along the cable.

25. A cable as defined in claim 22 in which the high impedance element is comprised of a high resistance second external shield surrounding the first external shield, and means associated with the shields for limiting VHF conductive current between the first and second external shields.

26. A cable as defined in claim 22 in which the high impedance element is comprised of a wire wound helically around the first external shield with a high pitch angle.

27. A cable as defined in claim 23, 25 or 26 further including a jacket surrounding the high impedance element, having low permittivity.

28. A cable as defined in claim 4, 13 or 14 including means for varying the permeability of at least one of the inner conductor and the external shields.

29. A cable as defined in claim 4, 13 or 14 including means for applying a secondary magnetic field to the inner conductor and external shields for varying their permeability.

30. A cable as defined in claim 13 or 16 including means for passing a direct current along the helically wound wire conductor of the second external shield.

31. A cable as defined in claims 2–10, 13–18, 22, 23, 25 or 26, further including a thick insulating jacket formed of low permittivity material surrounding the second external shield.

32. A leaky cable comprising an inner conductor, a dielectric surrounding the inner conductor, and at least one shield surrounding the dielectric, the at least one shield which is adjacent the conductor being apertured, and means for varying the magnetic permeability of at least one of the inner conductor and an outer shield whereby series inductance of the cable can be varied, thereby varying its propagation characteristics.

33. A leaky cable as defined in claim 32, in which the outer shield of the cable is comprised of a helically wound wire, and means for passing direct or alternating current down the helically wound wire, thereby to set up a respective unvarying or varying magnetic field and thus varying said magnetic permeability.

34. A leaky coaxial cable comprising a pair of spaced parallel elongated conductors, a dielectric surrounding each of the conductors, first external shields surrounding each of the dielectrics, each first external shield having apertures located therein so as to minimize direct coupling between the conductors of a transmission line formed by the two elongated conductors and the first external shields, the first external shields being in conductive contact therealong, a second external shield surrounding the entire structure, and means associated with the shield for limiting VHF conduction current between the first and second external shields.

35. A cable as defined in claim 34 in which the second external shield is formed of high resistance foil material surrounded by and in conductive contact with a helically wound wire conductor forming a high inductance element.

36. A cable as defined in claim 34 or 35, in which the first external shields are short circuited to each other at a minimum of several points per wavelength of VHF signals to be carried by the cable along the cable.

37. A cable as defined in claim 34 or 35 including means for varying the permeability of at least one of the inner conductors and the first external shields.

38. A cable as defined in claim 34 or 35 including means for applying a secondary magnetic field to the inner conductors and first external shields for varying their permeability.

39. A cable as defined in claim 34, in which each first external shield is comprised of a layer of wires helically wound with a low pitch angle around each of the dielectrics, each layer being covered with a foil.

40. A cable as defined in claim 34 in which each first external shield is comprised of a foil around a dielectric, and a layer of wires wound helically with a low pitch angle around the foil.

41. A leaky coaxial cable comprising a pair of spaced, parallel elongated conductors, a dielectric surrounding each of the conductors, a first external shield having S-shaped cross-section elongated conductive material, said S-shaped cross-section being formed of arms joined at a spine, the shield embracing each dielectric in corresponding ones of its arms, whereby the dielectrics are uncovered by the conductive material on opposite sides of the spine of the S-shape of the conductive material, a second highly inductive external shield surrounding the entire structure, and means associated with the shield for limiting VHF conduction current between the first and second shields.

42. A cable as defined in claim 41, in which the second external shield is comprised of a wire wound helically with a high pitch angle around and in contact with a high resistance foil.

43. A cable as defined in claim 34 or 41 in which the second external shield is comprised of high reactance wire wound with a high pitch angle around the structure.

44. A cable as defined in claim 41 or 42, in which the limiting means is comprised of one of a thin insulator and semiconductor.

45. A leaky coaxial cable comprising a pair of spaced, parallel, elongated conductors, a dielectric surrounding each of the conductors, separate first external conductive Shield means surrounding at least the major portion of each of the dielectrics, the shield means being short circuited along the cable parallel to the pair of conductors, a second external shield means surrounding both the first conductive shield means together, means associated with the shields for coupling magnetic fields which may surround each of said elongated conductors through the external shield means, and means associated with the shields for limiting VHF conduction current between the first and second shields.

46. A cable as defined in claim 45 in which the second external shield means has high series impedance and includes a wire spirally wound around the cable forming a high inductance, and in which the first external shield means is formed of an inner layer of wires wound with a low pitch angle around each of the dielectrics surrounded by a foil.

47. A cable as defined in claim 45 or 46 in which said means for limiting is comprised of one of a thin insulator and semiconductor layer separating the second external shield means from the first external shield means.

48. A cable as defined in claim 46, in which at least one of said elongated conductors, and first and second external shield means is comprised of high permeability core material coated with a high conductivity material.

49. A cable as defined in claim 46, in which each of the pair of said elongated conductors is formed of high permeability core material coated with a high conductivity material, and in which the second external shield means includes high resistance material formed of high permeability material immediately below the spirally wound wire.

50. A cable as defined in claim 46, in which each of the pair of said elongated conductors is formed of high permeability core material coated with a high conductivity material, and in which the second external shield means includes high resistance material formed of high permeability material immediately below the spirally wound wire, and further including means for passing direct current through the wire for altering the permeability of the core material and high resistance material.

51. A cable as defined in claim 34, 42, 45, 46, 48, 49 and 50, further including a jacket formed of low permittivity material surrounding the second external shield means.

* * * * *